US007930844B2

(12) United States Patent
Quarfordt et al.

(10) Patent No.: US 7,930,844 B2
(45) Date of Patent: Apr. 26, 2011

(54) SELF-SHARPENING, AUTO-SIGNALLING WEARING PART

(75) Inventors: Per Quarfordt, Storfors (SE); Klaas Wijma, Haarlem (NL); Stefan Ederyd, Saltajö-Boo (SE)

(73) Assignees: Combi Wear Parts AB, Kristinehamn (SE); Vosta LMG B.V., Amsterdam (NL)

( * ) Notice: Subject to any disclaimer, the term of this patent is extended or adjusted under 35 U.S.C. 154(b) by 0 days.

(21) Appl. No.: 12/741,128

(22) PCT Filed: Oct. 31, 2008

(86) PCT No.: PCT/SE2008/000619

§ 371 (c)(1),
(2), (4) Date: Jun. 28, 2010

(87) PCT Pub. No.: WO2009/061248

PCT Pub. Date: May 14, 2009

(65) Prior Publication Data

US 2010/0251580 A1 Oct. 7, 2010

(30) Foreign Application Priority Data

Nov. 9, 2007 (SE) ..... 0702491

(51) Int. Cl.
*E02F 9/28* (2006.01)
*E02F 3/00* (2006.01)

(52) U.S. Cl. ..... 37/453; 37/460

(58) Field of Classification Search ..... 37/452–460, 37/450, 451, 446, 398, 444, 219, 264, 266; 299/79, 111, 113; 172/701.3, 703, 747, 781; 175/426, 427

See application file for complete search history.

(56) References Cited

U.S. PATENT DOCUMENTS

| | | | | |
|---|---|---|---|---|
| 3,326,302 | A | 6/1967 | Washbond et al. | |
| 5,081,774 | A | 1/1992 | Kuwano | |
| 5,502,905 | A * | 4/1996 | Cornelius et al. | 37/460 |
| 5,778,572 | A * | 7/1998 | Lukavich et al. | 37/460 |
| 5,785,109 | A | 7/1998 | Hongawa | |
| 6,571,493 | B2 * | 6/2003 | Amano et al. | 37/460 |
| 6,757,995 | B2 * | 7/2004 | Pippins | 37/468 |

FOREIGN PATENT DOCUMENTS

| | | | |
|---|---|---|---|
| AU | 652524 | B1 | 8/1994 |
| CA | 1211136 | A1 | 9/1986 |

* cited by examiner

*Primary Examiner* — Robert E Pezzuto
(74) *Attorney, Agent, or Firm* — Connolly Bove Lodge & Hutz LLP

(57) ABSTRACT

Self-sharpening wearing part having improved abrasion resistance and strength, which wearing part comprises at least a first and a second material part. The first material part is constituted by a casting body and the second material part is comprised of at least one elongated hard metal rod which is fixed in the first material part. The wearing part produces an auto-signal when the part must be changed due to wear.

20 Claims, 7 Drawing Sheets

Figure 1:
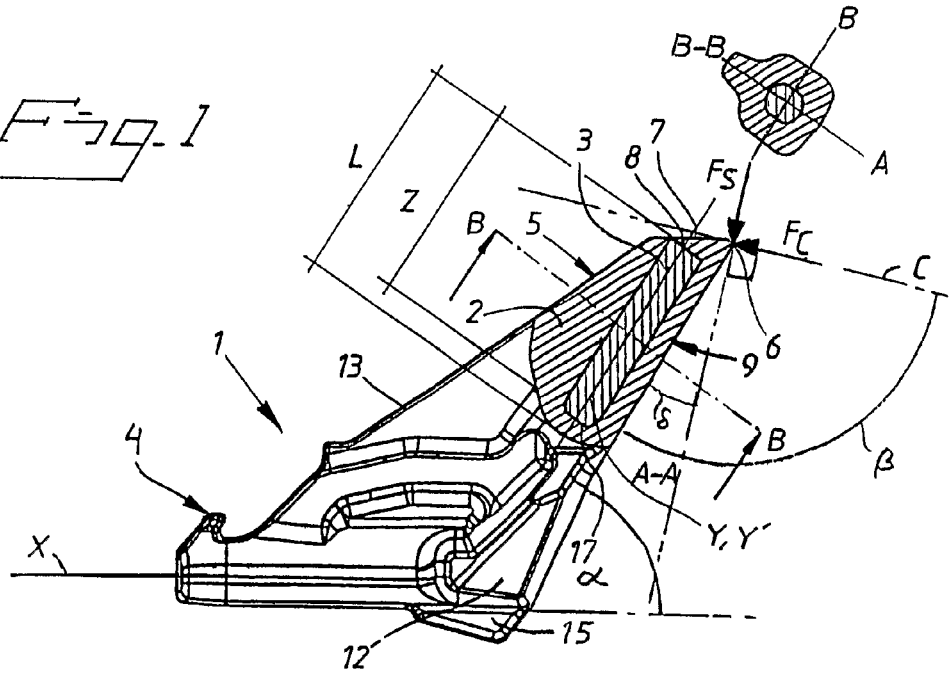

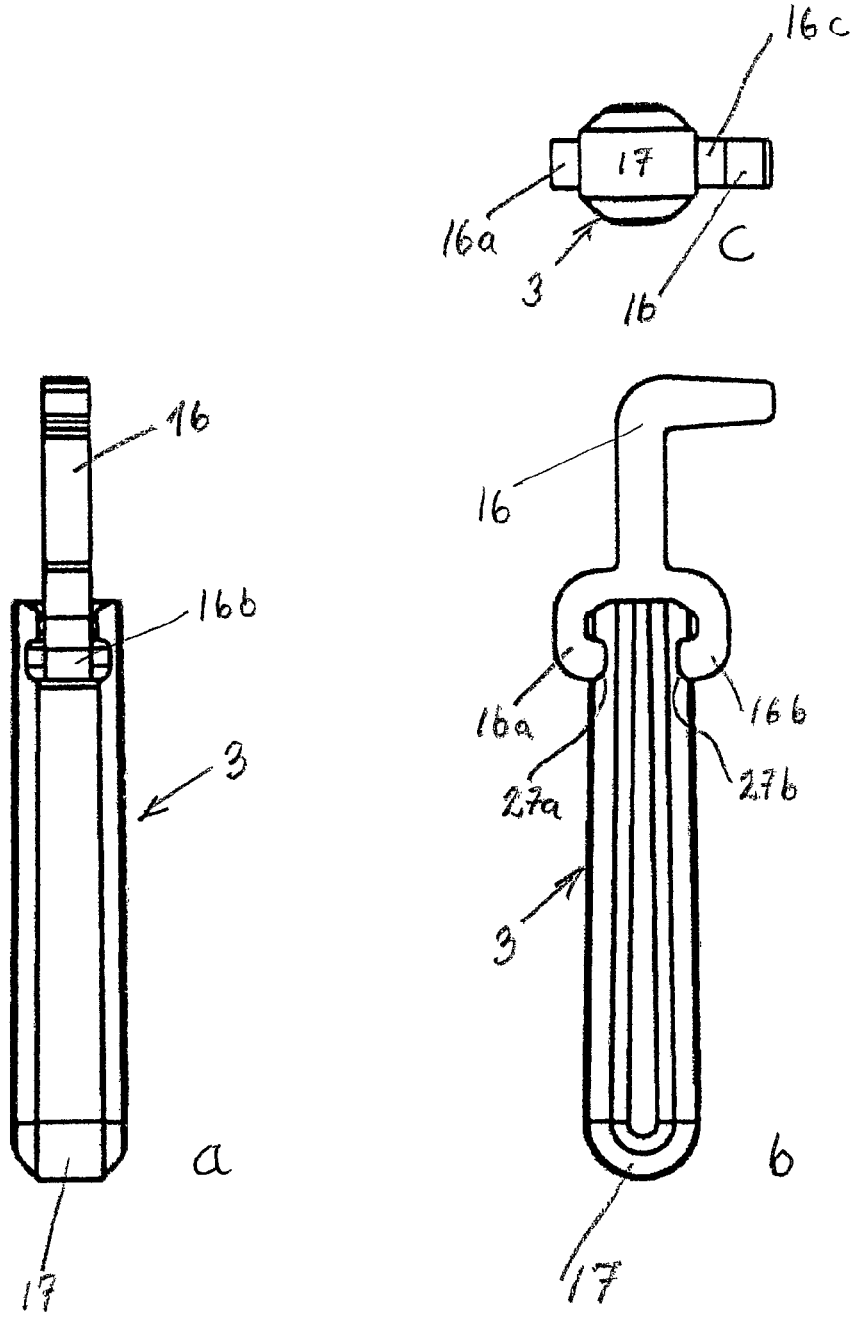
Fig 12 a-c

SELF-SHARPENING, AUTO-SIGNALLING WEARING PART

This application is a 35 U.S.C. §371 National Stage Application of International Application Serial No. PCT/SE2008/000619, filed Oct. 31, 2008, which claims priority from Swedish Application No. 0702491-2, filed Nov. 9, 2007, the entire disclosures of which are incorporated herein by reference in their entireties.

TECHNICAL FIELD

The present invention relates to a wearing part having improved abrasion resistance and strength, which wearing part comprises at least a first and a second material part, which first material part is constituted by a casting body of a casting alloy, which casting body comprises a rear fixing part for detachable fixing to a holder part in a working tool and in which working tool the wearing part constitutes an exchangeable consumable part, and also a front neck, projecting from and at an angle to the longitudinal axis X through the rear fixing part, which projecting front neck has an outer tip, having at least one tip wearing surface placed outermost on the said outer tip and which tip wearing surface constitutes the part which is to work actively against a working surface C, the said projecting neck being worn down starting from the at least one tip wearing surface at the said outer tip, wherein the second material part is comprised of at least one elongated hard metal rod, which at least one elongated hard metal rod is fixed in the longitudinal plane of symmetry A of the wearing part, substantially axially inside the projecting neck of the first material part, which at least one elongated hard metal rod comprises at least one free rod wearing surface constituting a part of the larger tip wearing surface of the said outer tip, whilst all other sides of the at least one elongated hard metal rod(s) are enclosed and fixed in place by the said first material part.

PROBLEM DEFINITION, BACKGROUND OF THE INVENTION AND PRIOR ART

There are currently a number of different commercial wearing part systems comprising exchangeable wearing parts, which are detachably disposed in wearing part holders mounted on the tool of a soil-working machine, for the loosening and separation of more or less hard soil and rock materials from a working surface, whereafter these worked materials can be suitably removed. One example of such wearing part systems, tools, wearing parts and wearing part holders is here specifically constituted by the rotary cutter head of a dredger, also referred to below as a dredger cutter, with its tooth system comprising exchangeable wearing parts, also referred to as wearing teeth, which wearing teeth are detachably mounted in tooth holders. Such wearing part systems can also, of course, be used in other types of soil-working machine tool, such as in a shovel for a digger, in a rock blade or a drill bit, etc.

In the case of dredger cutters specifically, the said wearing teeth are arranged at a certain distance apart, along more or less curved arms or spiral, elongated cutter head blades which protrude in plural from a central rotation body disposed on a central hub which is rotatable via a drive shaft. The cutter head blades expediently extend helically from the hub at the front end of the rotation body and rearwards in the direction of feed of the tool to the rear end of the rotation body, normally comprising an annular part, which holds together the cutter head blades and in which there is also arranged a suction device for carrying away the loosened, worked materials via a space between the said cutter head blades.

Such tooth systems usually comprise two main coupling parts in the form of a "female part" and a "male part", which, in mutual interaction via a common geometric form which is precisely matched for the female part and the male part, together form one piece, a composite "tooth", i.e. the said tooth system, which composite tooth can be one in a series of teeth arranged adjacent to one another along, for example, the front edges of the cutter head blades, the cutter of a drill bit, or the sharp cutting edge of the shovel and of the rock blade. How far the female part or the male part is mounted on the tool is of minor importance, the important thing is that the two coupling parts are removable and lockable in relation to each other and that the part which constitutes the holder part is permanently fixed to the tool.

A "composite tooth" of this type therefore comprises a first coupling part, namely the abovementioned wearing part in the form of, for example, an exchangeable front wearing tooth having some form of working part, for example a tip or a cutting edge, and also comprising a fixing part, preferably its—in relation to the body or neck thereof, for example a tooth body or tooth neck—rear or lower part, for example a rear shaft or opening, for mounting in a specific groove, opening or pin, custom-made for just this type of wearing parts, in a second coupling part, i.e. the rear or lower fixed holder part, here the tooth holder. In order to achieve a dynamic, yet still reliable securement of the exchangeable wearing tooth on the tooth holder, the coupling parts also comprise a coupling system which is common to the parts and has a releasable locking mechanism. Each such coupling system has an extremely characteristic geometry, in which the respective coupling part contains its own specific solution, comprising mutually interacting surfaces and forms of the abovementioned shaft, groove, etc., one or more securing elements, for example a locking pin, and/or one or more clamping devices for realizing a clamping of the wearing part on the holder part, compare SE-524 301 (EP-1 644 588), in an attempt to get the wearing part of each "tooth" to be held fully fixed in the intended place and in the correct position in an effective, secure and functional manner, also involving just a minimal wear between the coupling parts, until the wearing part, due to the nonetheless unavoidable wear, has to be released and replaced by a new wearing part for continued use of the particular tool.

Known commercial tooth systems of this type are designed to absorb loads (F) from the use of the tool via the specially configured and mutually interacting contact zones, which are arranged along the joint between the coupling parts constituted by the shaft, the pin and the groove or opening.

It will be appreciated, however, that, during use of the tool, not only loads which are parallel with the longitudinal plane of symmetry A of the coupling geometry, but also loads which deviate from this plane of symmetry, are in action. Essentially each acting load (F) therefore comprises, see FIG. 1 and FIG. 3, firstly a shearing force component $F_c$, which acts substantially from the front, parallel with the working surface and substantially axially in relation to the said joint, secondly a normal force component $F_s$, which acts substantially from above, perpendicular to the working surface, and thirdly at least one lateral transverse force component $F_p$, which acts from the side or the sides, substantially parallel with the working surface and more perpendicular in relation to the extent of the said wearing tooth along the plane of symmetry A, i.e. the said tooth neck thereof, which constitutes a more strongly protruding extension of the tooth body, in front of the common joint of the coupling parts, which tooth neck, during use of the wearing part, shall project from and at a certain specific angle to the rest of the tooth body. The lateral transverse force component $F_p$ is typically smaller than the shearing force component $F_c$ and the normal force component $F_s$.

Positional terms which are used in this description, such as rear, front, lower, upper, vertical, lateral or horizontal, etc., can consequently be derived from the above-given definitions for the said forces and the mutual relationship of the coupling parts, as well as their position relative to the working surface.

The new concept for a tooth system according to the present patent application comprises a number of characteristics, which characteristics alone or in combination are unique compared with the currently known tooth systems, and which characteristics provide advantageous solutions to a number of problems which can arise in the known tooth systems.

In conventional tooth systems, it is a fact that, though the tooth systems are relatively strong, they have an over-rapid wear-down of the bearing surfaces, or other working surfaces exposed by the operation, which, for example, bear against or have a driving, transporting, penetrating, crushing, shearing, etc. effect upon the working surface. All such surfaces exposed to abrasion or wear are also referred to below as wearing surfaces, regardless of specific function. In the embodiments shown in this application, the wearing parts are of the type which are removable, yet during the work are wholly fixed in relation to the said tool, which wearing parts are fixed in the holder parts outermost on the tool, in contrast to those wearing parts which are removable but are additionally rotatable about their own longitudinal axis. It is presumed, however, that a person skilled in the art will grasp how the wearing parts according to the invention may be applied to many types of working tool, even if these are not expressly illustrated with examples herein.

In a dredger having a rotary cutter head, for example, the dredger vessel is anchored rotatably in the stern of the dredger vessel. Winches are disposed to the port and starboard of the prow of the vessel, which winches are anchored in the seabed and with which the prow of the vessel can be winched in a motion pendulating from side to side about the aft anchorage, at the same time as the cutter head is rotated about its drive shaft. In this rotary use of the wearing teeth, the tooth tip is normally worn from primarily one of its two opposite lateral sides at the front end of the tooth neck due to the said lateral transverse force component $F_p$, i.e. one of the two, in relation to the extent of the neck, longitudinal sides constitutes the bearing surface, or a first wearing surface, against the working surface, but since the dredger tool is also guided back and forth over the seabed in the said pendulum and sweeping motions with the aid of the winches, a wear-down of the opposite side also occurs, whereupon a second wearing surface is formed.

Since the acting force components $F_p$, $F_s$, $F_c$ are constantly changing in strength and act from many directions, the steel can suffer fatigue, and if then the different strength properties of the steel are at the same time too low to withstand the harsh dredger work, the cast steel of the tooth tip tends to be split also into largish splinters or fragments, which very quickly wears down the whole of the tooth neck until the wearing tooth becomes ineffectual and also the tooth holder risks becoming damaged if a change is not made in time. The conventional dredger wearing parts which are currently used therefore become worn far too quickly and have to be changed and replaced with new wearing teeth far too often, resulting in expensive tooth costs and many costly operating stoppages. Similarly disadvantageous developments also prevail in other types of wearing tool. It is additionally the case that the tooth neck has a maximum possible extent, and thus a maximum working length or wear length, which is determined by, for example, maximum permitted buckling and bending load. Should the loads upon the cast steel become excessive, an over-long tooth neck will quite simply be able to be broken off and immediately render the wearing tooth totally unusable.

In order to prevent this, it is known that wearing teeth have a cross section which increases towards the base, whereby, in turn, the clearly disadvantageous characteristic is acquired that each contact surface or wearing surface becomes increasingly blunt the more the wearing surface is worn, so that the penetrative action of the wearing tooth finally becomes quite worthless.

At present, the cutter head of the dredger tool has to be raised from the water in order to be able to check which wearing teeth need changing. This means, firstly, that certain wearing teeth are changed unnecessarily, since the cutter head was up anyway and it was felt in the inspection that the wearing tooth would not last out till the next visual inspection and, secondly, that certain wearing surfaces are changed too late, so that the tooth holders in certain cases suffer serious damage. That this is very disadvantageous will be easily appreciated if one is aware that, in a typical dredger in full operation, between 4,000 and 5,000 wearing teeth are changed per week. If just 5% are changed unnecessarily, this gives a very large extra cost per week.

Another disadvantage which must here be taken into account is that the wearing tooth which is left contains valuable metal which should be recovered. If, as in certain wearing parts which are currently used, hard metal grain or hard metal chips is/are mixed into the cast steel in order to increase the wear strength, a difficulty arises of economically recovering the two different metal materials.

There is therefore a desire to firstly solve the problem with the over-rapid wear-down, the currently far too short wear length, the random and uncontrollable exchange of wearing teeth which are not yet fully worn down, combined with the fact that certain wearing teeth are changed when the tooth holder has already suffered serious damage, and that the recovery in certain cases is both costly and complicated.

Patent specification SE 449,383 (U.S. Pat. No. 4,584,020) shows in FIG. 3 a digging or dredging tooth comprising a cast alloy and a wearing layer of a cast-in hard metal. Although this wearing tooth comprises an inner wearing layer, firstly this is arranged over the entire width of the tooth tip and is thus blunt, even as new, so that it does not have an optimal penetrating function, and secondly the wearing layer is disposed neither in the centre line of the tooth or in its two planes of symmetry A, B, so that the wear-down will make the wearing tooth still more blunt and ineffectual, i.e. it must either be discarded prematurely or it must be ground such that its wearing layer again ends up in the centre line.

The cast steel in the said SE 449,383 (U.S. Pat. No. 4,584,020) which is used has a carbon content of between 1.5% by weight and 2.5% by weight, which gives too soft a steel, so that the inner wearing layer, will be gradually exposed a further bit at a time, whereby the wearing layer will quite simply be broken off. This since the breaking strength is too low for the wearing layer to be able to withstand the loads without the support of the cast steel. Therefore, regardless of the fact that the wearing part has an inner wearing layer, the wear-down will be disadvantageously quick, since the wearing layer will actually be broken off in quite large fragments before it experiences any effectiveness-raising effect. In addition, it is maintained that a steel film with low carbon content (<0.20%) must be placed around the hard metal body. The melting point for the film must be 200-400° C. higher than the melting point for the cast alloy.

The nodular cast iron which is used in the prior art generally has a low hardness of around 38 HRC, and the wearing layer, which is a low-alloyed steel, has a hardness of between 40 and 53 HRC, which means that the low-alloyed steel matrix in the abovementioned wearing part only acquires approximately double the strength relative to a comparable cast iron product according to the prior art. Moreover, this is only a theoretical ratio, since the reality is that the wearing part, due to the brittleness of the wearing layer and the lack of supporting cast steel, which cast steel, as stated above, is too soft to be hard-wearing and is therefore worn away quickly, becomes still weaker. The way to solve this therefore remains an unresolved problem, which problem, despite long-lasting awareness thereof, has never satisfactorily been solved, in spite of the significant economic incentive as set out above. Based on the above prior art, it is clear that it has hitherto been felt that a hard metal should be cast into an iron alloy with relatively high carbon content in order to create a body, and in which prior art the said body is subsequently cast into an iron alloy with lower carbon content, for example according to U.S. Pat. No. 4,584,020.

Previous attempts at casting of low-alloyed steel have resulted in the dissolution of the hard metal in a bonding zone against the cast steel, and the formation in the said bonding zone of brittle tungsten-iron carbide fibres. Moreover, in this fusion of the cast steel and hard metal surfaces, any impurities or moisture can give rise to disadvantageous gas bubbles and hence cavities in the bonding zone inside the cast wearing part, which causes poorer adhesiveness and poorer strength in the said bonding zone and hence the above-stated uncontrollable splitting of the wearing surfaces into largish splinters or fragments, which very rapidly wears down the whole of the tooth neck, regardless of whether a hard metal is provided or not, to the point where the wearing tooth becomes ineffectual or the tooth holder is damaged.

The actual placement of the cast-in part, in this case the wearing layer of hard metal, in the casting mould in itself constitutes a problem, since the cast-in part moves away when the cast steel melt is poured down into the space for it in the casting mould. Previous solutions have involved, for example, various supports inside the said space, which supports were then melted and combined with the cast steel melt in the casting operation. It will be appreciated that this known method gives rise to a significant risk of the cast-in part moving from the desired position when the supports melt and, moreover, this melt of the supports forms an impurity in the cast compound, which alters the desired properties of the wearing part and the bonding zone between the cast-in part and the rest of the cast steel. For example, a poor adhesion can be caused, bubbles can appear and brittle metal mixtures can be formed in the cast steel in the said bonding zone during the casting of the wearing part.

OBJECT OF THE INVENTION AND ITS CHARACTERISTIC FEATURES

One object of the present invention and its various embodiments is to provide an improved wearing part for detachable fixing to a holder part in a working tool for realizing this wearing part, which wearing part substantially reduces, ideally eliminates the above-stated problems, wherein wearing parts with hard metal reinforcement can be put to better use than previously.

A refinement of this object is to provide, with the present invention and its various embodiments, a self-sharpening wearing part for detachable fixing to a holder part in a working tool for realizing the said self-sharpening, which self-sharpening wearing part substantially reduces, ideally eliminates the above-stated problem of blunt wearing parts.

The said objects, as well as other objects which are not listed here, are satisfactorily met within the scope of that which is specified in the present independent patent claims. Embodiments of the invention are defined in the independent patent claims.

Thus, according to the present invention, an improved wearing part has been produced, which is characterized in that

- the at least one elongated hard metal rod of the wearing part is arranged with its centre in the force-neutral zone of the projecting neck, substantially concentrically in the longitudinal axis Y of the projecting neck, and comprises a length Z which is shorter than the length L of the projecting neck with an inner cast-in end distinctly terminated at a certain distance from the longitudinal axis X of the rear fixing part, so as to produce an auto signal comprising registerable vibrations at the final wearing-away of the inner cast-in end and by that an auto-reporting function that a change of wearing part is required during operation.

According to further aspects of a wearing part according to the invention:

- the inner cast-in end, at the fixation of the rear fixing part inside the holder part, is terminated at a certain distance from the top side of the tooth holder and hence also at a certain further distance from the longitudinal axis X of the rear fixing part inserted into the tooth holder,
- the first material part comprises a material which has a lower abrasion resistance than the elongated hard metal rod, and in that that the ratio between the lower strength of the first material part and the higher strength of the elongated hard metal rod is made such that the free rod wearing surface of the elongated hard metal rod in relation to the rest of tip wearing surfaces of the first material part is always more protruding than the surrounding projecting neck so as to produce a self-sharpening capability,
- the wearing part comprises at least two wearing surfaces having different abrasion resistance, which said at least two wearing surfaces are arranged such that the abrasion resistance rises in the radial direction of the elongated hard metal rod so as to produce a self-sharpening capability of the wearing part,
- the at least two wearing surfaces of the wearing part are arranged in concentric layers around the elongated hard metal rod,
- the elongated hard metal rod is arranged at an angle ($\lambda$) within the range 0-15 degrees in relation to the longitudinal axis Y of the projecting neck,
- the elongated hard metal rod is arranged with a length (Z) which is between 80-95% of the length (L) of the projecting neck calculated from the centre of it's original tip wearing surface of the outer tip,
- the elongated hard metal rod is constituted by a material which has a mean hardness of between 800 and 1750 HV3,
- the working tool for the wearing part comprises a sensor arranged to register the registerable vibrations at the final wearing-away of the inner cast-in end and by that indicate that the elongated hard metal rod is worn out and must be changed,
- the elongated hard metal rod is configured as a truncated cone, the elongated hard metal rod has a maximum width of between 10 mm and 30 mm, the cross section of the elongated hard metal rod transversely to the longitudinal axis of the elongated hard metal rod has a square or rectangular form, the cross section of the elongated hard metal rod transversely to the longitudinal axis Y' of the elongated hard metal rod has a circular or elliptical form, the wearing part comprises a first hard metal rod arranged centrally in the said wearing part and at least one further hard metal rod arranged peripherally in relation to the first hard metal rod, the wearing part comprises at least one reinforcing portion disposed between the outer tip of the wearing tooth and the rear fixing part of the wearing tooth.

The said objects, as well as other objects which are not listed here, are satisfactorily met within the scope of that which is specified in the independent patent claims. Embodiments of the invention are defined in the independent patent claims.

ADVANTAGES AND EFFECTS OF THE INVENTION

According to the present invention and its embodiments, a number of advantageous effects are obtained.

A wearing part which has an increased performance and a better hardness against wear can be obtained if a hard metal is cast into cast steel by casting, in which the cast steel has a low carbon content and in which the temperature during the casting process is precisely checked and in which use is made of a hard metal having a carbon content which lies close to graphite formation.

The service life of the new wearing tooth increases significantly with the enclosed more durable, harder core of hard metal, compared with the previously used wearing tooth of conventional homogeneous steel material. The wear strength with the cast-in hard metal rod is at least 4-5 times higher compared with a conventional wearing tooth with no such hard metal rod. Even though the cost of the hard metal rod would double the cost of the wearing part, it is still very economical, since a very strong increase in service life, of several hundred %, can be obtained.

In the use of the wearing teeth, the tooth tip normally becomes worn primarily on one side of the two lateral sides of the tooth neck, i.e. the two, in relation to the extent of the neck, longitudinal sides, since the cutter head rotates, but since the dredging tool is also guided back and forth over the seabed in pendulum and sweeping motions with the aid of the winches, a wear-down on the opposite side also occurs, so that a ridge-shaped or spine-shaped cutting edge or cutter can be formed substantially directly over the middle of the tip surface and the centre line of the hard metal rod, which ridge or spine is substantially parallel with the longitudinal extent of the tooth holder and of the longitudinal extent of the tooth neck. This cutting edge is then constantly whetted by the said rotary and pendulum motions, until the hard metal rod runs out. Were the wear-down of the cast steel to be so rapid that a longer bit of the hard metal projects, then this could be broken off to suitable length and then quickly resharpened to the said keen, crest-shaped cutting edge. The previous wearing teeth using hard metal grain or hard metal chips in the cast steel to increase wear strength do not therefore provide the substantial advantages obtained by the present invention with a hard metal rod arranged in the plane of symmetry A.

The wearing tooth on the cutter head blades of the dredger is arranged with a positive cutting angle against the working surface, i.e. with an angle of attack which cuts down in the ground surface, in contrast to a negative angle of attack, which trails only on top of the working surface and which can only scrape away material, since the actual cutter comes after the blade, viewed in the direction of advance.

Further advantages and effects will emerge from a study and consideration of the following, detailed description of the invention, including a number of its advantageous embodiments, the patent claims and the accompanying drawing figures.

LIST OF FIGURES

Figure 2:
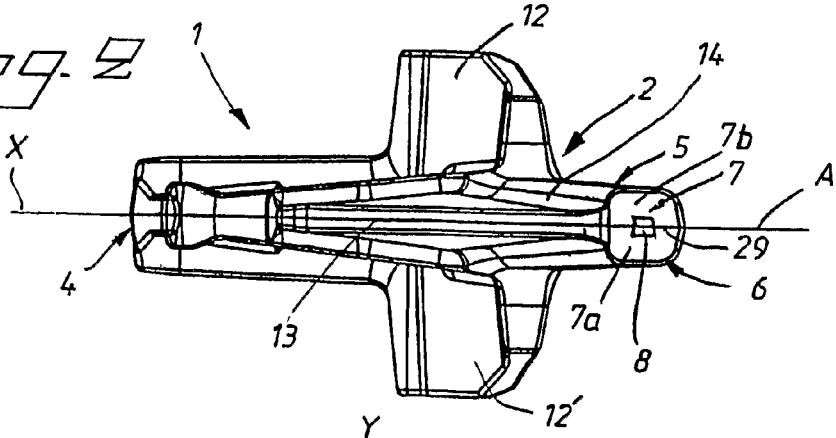
Figure 3:
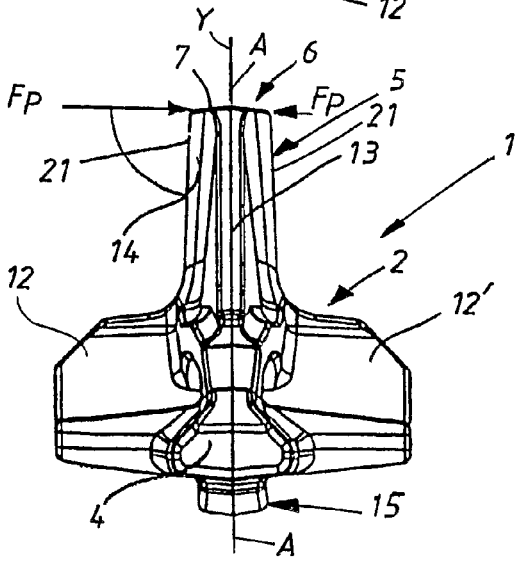
Figure 4A:
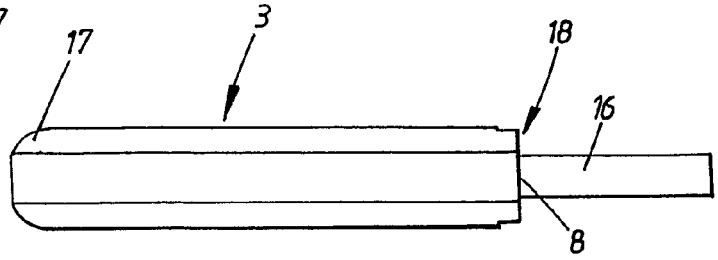
Figure 4B:
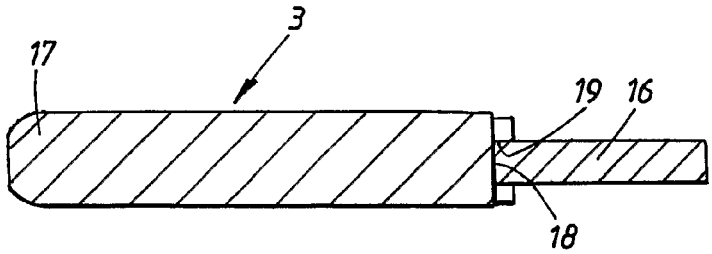
Figure 4C:
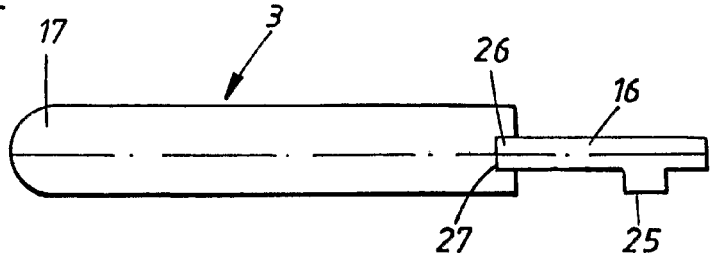
Figure 4D:
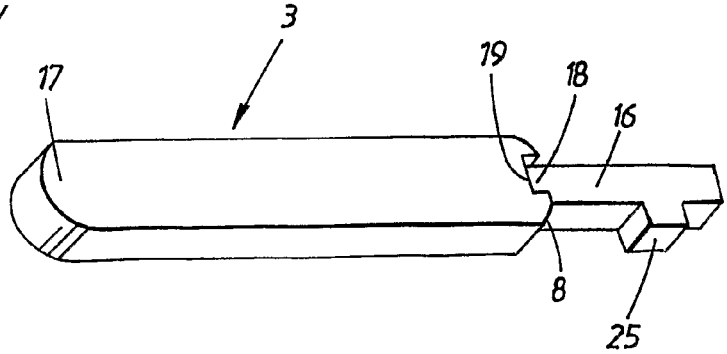

The invention will be described in greater detail below with reference to the appended figures, in which:

FIG. 1 is a schematic side view of parts of a preferred embodiment of a wearing tooth according to the present invention, comprising an obliquely upwardly arranged tooth neck, against which tooth neck the shearing force component $F_c$ and normal force component $F_s$ of an acting load are shown schematically, and in which an upper portion of the tooth neck is shown in a partial longitudinal section, a cast-in part in the form of a hard metal rod being shown separately, FIG. 2 shows a schematic plan view of the wearing tooth according to FIG. 1 in top view, showing a rear fixing part for detachable and lockable fixing in a tooth holder, and outermost on the front part of the tooth neck two wearing teeth on either side of a centre line showing the longitudinal plane of symmetry A of the wearing tooth, FIG. 3 is a schematic end view of the wearing tooth according to FIG. 1 in rear view, showing a reinforcing side wing on either side of a spine-shaped reinforcing portion from the front part of the tooth neck and a below-situated torque lug, as well as a plurality of contact surfaces and clearance surfaces on the tooth body of the wearing tooth, intended for the transmission, and positioning, of generated loads between the coupling parts of the tooth system in positions selected for this purpose, as well as the lateral transverse force component $F_p$ of an acting load, FIG. 4*a-d* show schematically parts of the hard metal rod according to FIG. 1, FIG. 4*a-c* showing the free end of the hard metal rod protruding from the front tooth tip of the tooth neck, i.e. its fixing shaft, on the right in the picture, and its fixing end, metallurgically connected inside the tooth neck in the cast steel, on the left, as two side views and a longitudinal section. A desired breaking point via a notch in the form of a diametral change, and a recess in the wearing end formed later, after removal of the fixing shaft, are also shown in FIG. 4*d,*

Figure 5:
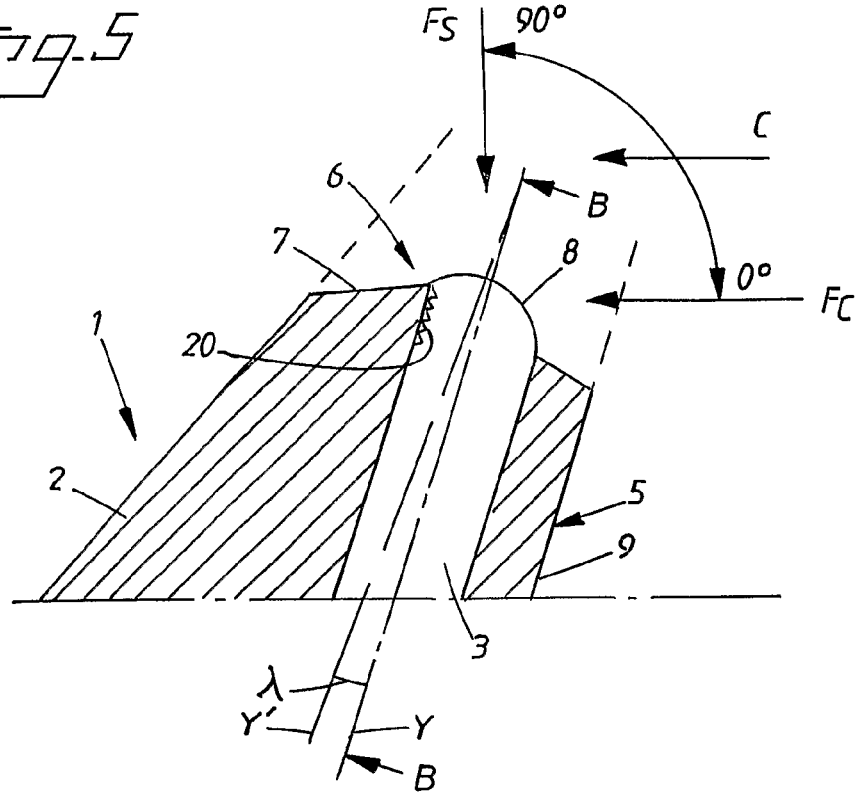
Figure 6:
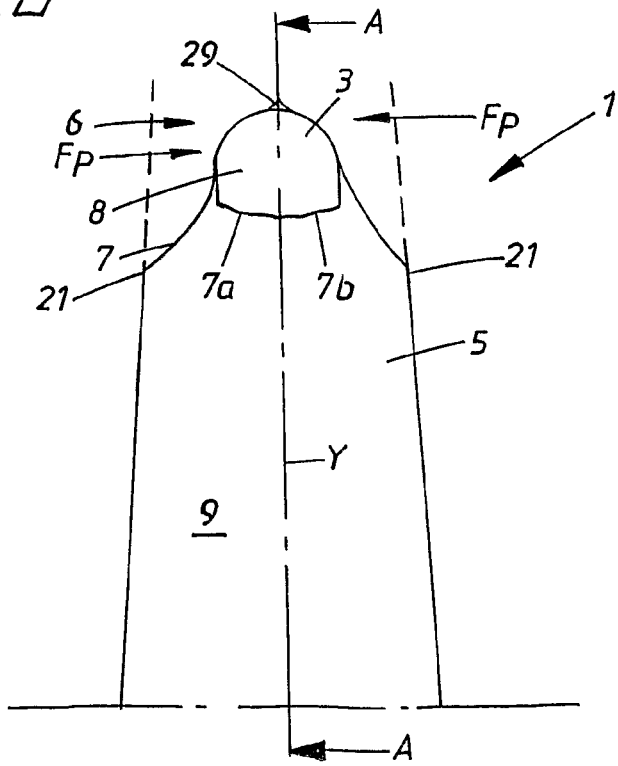
Figure 7:
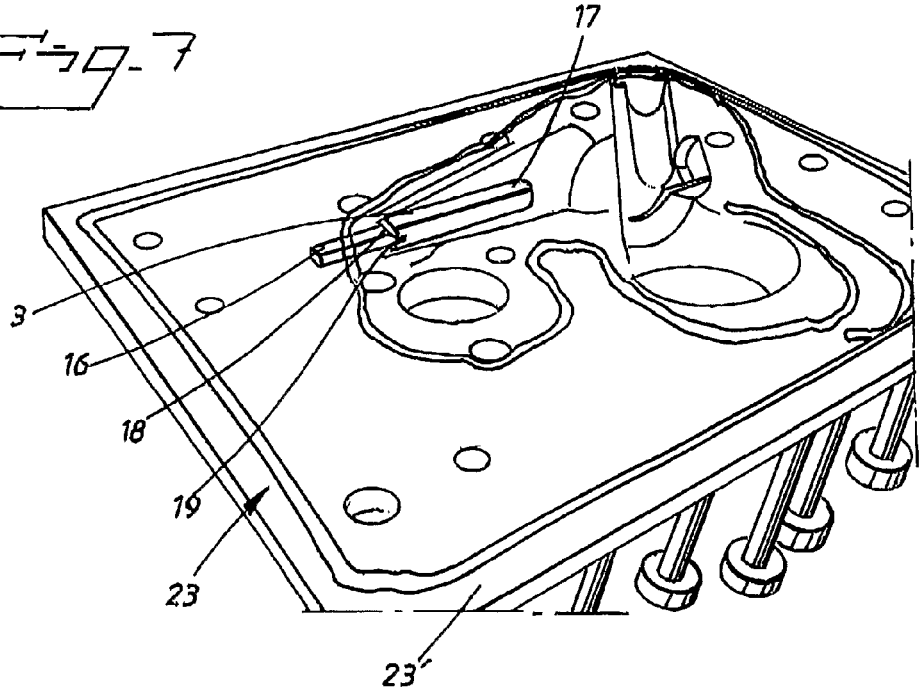
Figure 8:
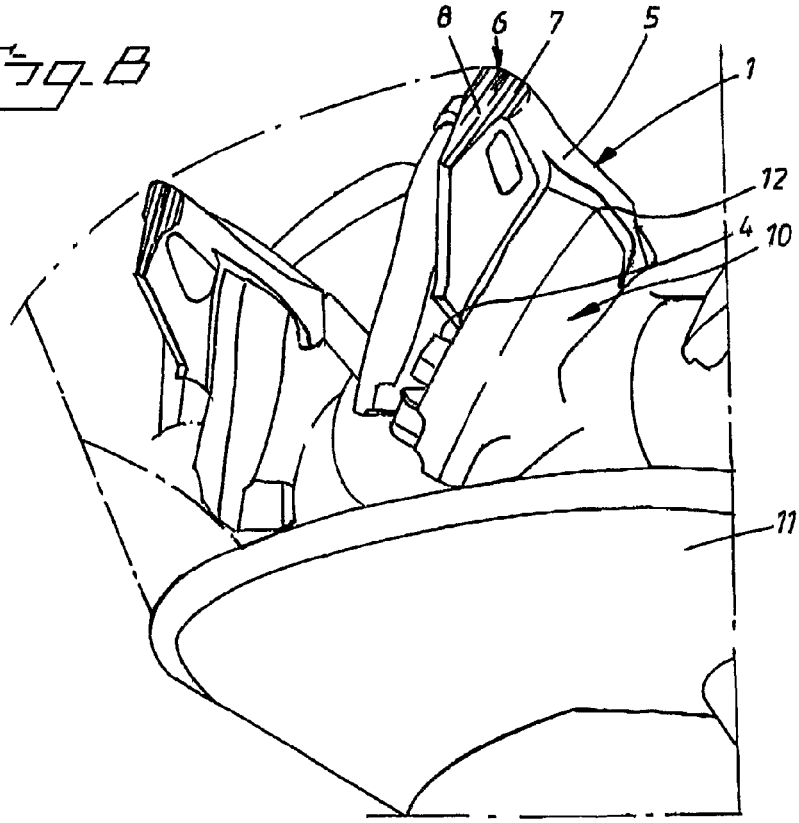
Figure 9:
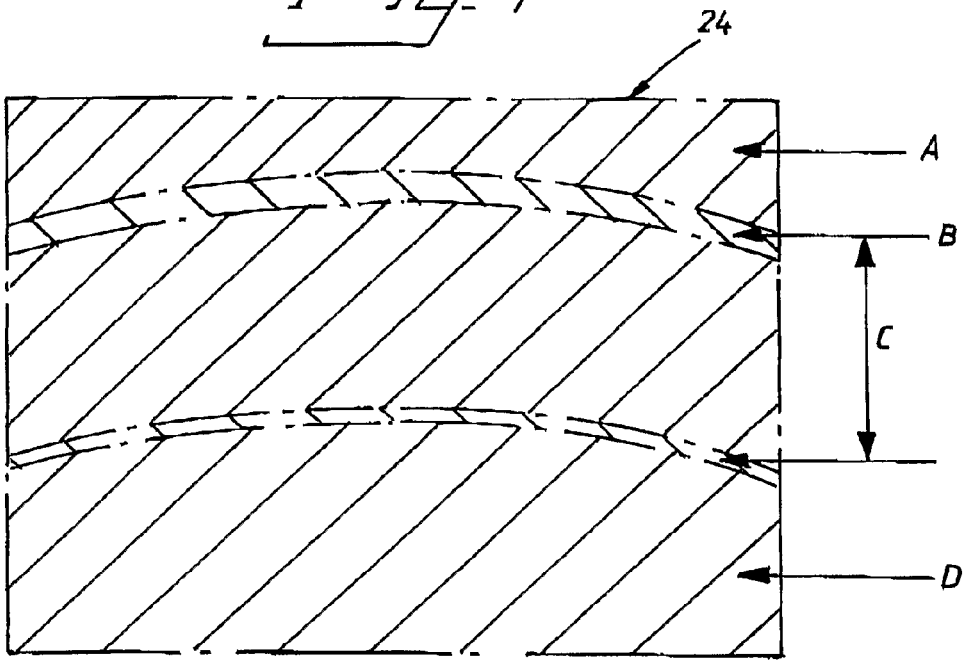
Figure 10:
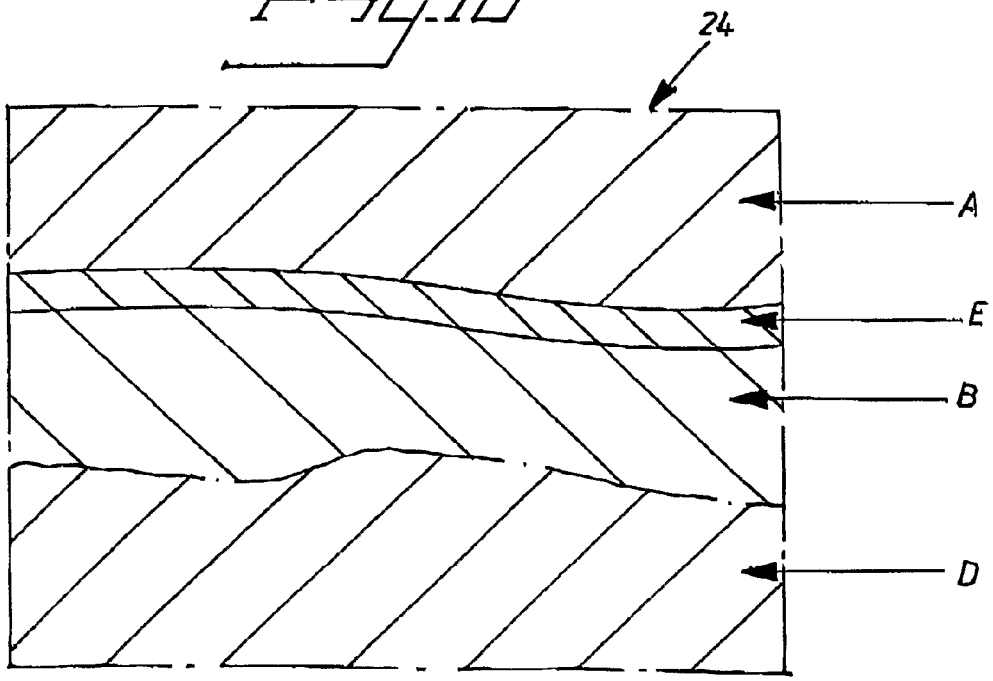
Figure 11:
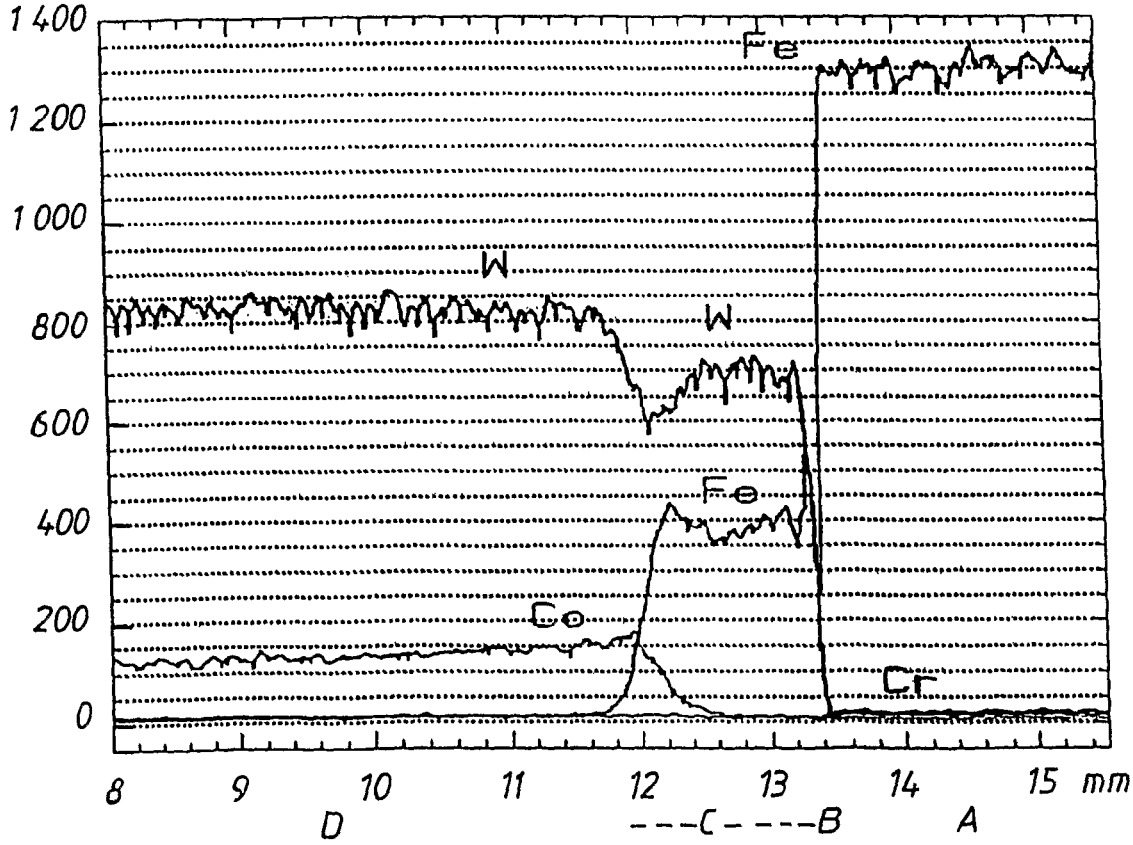

FIG. 5 shows schematically a cross section through the tooth neck according to FIG. 1, in which a supporting zone between the spine portion and the hard metal rod against the hard metal rod is specifically shown, inclusive of the 0-90° change of position of the acting load, i.e. the variation in size of the shearing force component $F_c$ and of the normal force component $F_s$, during operation of the cutter head, FIG. 6 is a schematic front view of the front part of the tooth neck, comprising the lateral wearing surfaces on either side of the wearing surface of the exposed hard metal rod, FIG. 7 shows schematically one half of a sand shell mould, in which a cast-in part in the form of the hard metal rod shown in FIG. 4, which here continues to have the later separated fixing shaft fixed in place in the correct position inside the profiled space of the sand shell mould for a cast steel melt, FIG. 8 shows schematically a part of a cutter head with shovel-shaped blades, on which cutter head blades a number of tooth holders with firmly fixed, but detachably arranged wearing teeth according to FIG. 1 are fastened, FIG. 9 is a light-optical microphotograph of the bonding zone between the steel of the hard metal rod and the cast steel following etching with Murakami and Nital. The following notations in FIGS. 9 and 10 are used: A—cast steel, B—eta-phase zone, C—bonding zone in the hard metal, D—unaffected hard metal, E—carbon-enriched zone in the cast steel, FIG. 10 is FIG. 9 but in greater enlargement, FIG. 11 shows the distribution of tungsten W, cobalt Co, iron Fe and chromium Cr, along a line perpendicular to the bonding zone. A—cast steel, B—eta-phase zone, C—bonding zone in the hard metal, D—unaffected hard metal, E—carbon-enriched zone in the cast steel.

FIG. 12*a-c* shows schematically a further embodiment of the hard metal rod according to FIG. 1, in which the fixing shaft is suitably made of structural steel of softer kind than the hard metal used for the cast-in end. The separate fixing shaft is fixed onto the hard metal rod by pressing a pair of gripping parts into a pair of cavities in the hard metal rod at the opposite end of the cast-in end.

DETAILED DESCRIPTION OF EMBODIMENTS

The same reference numeral is applied consistently below to a number of terms if the named component is constituted by the same detail in the figures, for example material part 3, cast-in part 3 and hard metal rod 3, which are all constituted by the same detail in the figures.

FIG. 1 shows schematically a preferred embodiment of a wearing part 1 having improved abrasion resistance and strength according to the present invention, which wearing part 1 is here specifically comprised by a wearing tooth 1. The wearing tooth 1 comprises at least two material parts 2, 3. The first material part 2 is constituted by a casting body 2 comprising a casting alloy, in this application also referred to as cast steel 2, and a front tooth neck 5, projecting obliquely upwards from a rear fixing part 4 and having an outer tooth tip 6 with at least one tip wearing surface 7, against which tooth neck 5, tooth tip 6 and tip wearing surface 7 the shearing force component $F_c$ and normal force component $F_s$ of an acting load are shown schematically, and wherein an upper portion of the tooth neck 5 is shown in a partial longitudinal section. The second material part 3 is constituted by at least one cast-in part 3, in the form of at least one elongated hard metal rod 3, for casting into the low-carbon cast steel 2 of the first material part 2, which hard metal rod 3, which is shown separately in the said longitudinal section, is fixed in the longitudinal plane of symmetry A of the wearing part 1, substantially axially inside the tooth neck 5 of the first material part 2, preferably also substantially concentrically in the longitudinal axis Y of the neck 5, which hard metal rod 3 comprises a free wearing surface 8, hereinafter referred to as a rod wearing surface 8, constituting a part of the tip wearing surface 7 of the said tooth tip 6, whilst, preferably, all other sides are enclosed and fixed by the said first material part 2.

FIG. 2 shows the rear fixing part 4 for detachable and lockable fixing in a holder 10, also referred to as a tooth holder 10, in a working tool 11, and in which working tool 11 the wearing tooth 1 constitutes an exchangeable consumable part and, outermost on the front part of the tooth neck 5, on its tooth tip 6, two parts 7*a*, 7*b* of the tip wearing surface 7, one on either side of a centre line showing the longitudinal plane of symmetry A of the wearing tooth 1 and which parts 7*a*, 7*b* enclose the hard metal rod 3. FIG. 3 shows a side wing 12, 12' reinforcing the strength of the tooth neck 5 on either side of a spine-shaped, triangular reinforcing portion 13 (also referred to as the spine portion 13) along the rear side 14 of the front part of the tooth neck 5, and a below-situated torque lug 15, as well as a plurality of contact surfaces and clearance surfaces on the casting body 2 of the wearing tooth 1, intended for the transmission, and positioning, of generated loads between the coupling parts of the tooth system in positions selected for this purpose, as well as the lateral transverse force component $F_p$ of an acting load.

When the wearing part 1 is in use, see FIG. 1, the shearing force component $F_c$ acts substantially from the front, parallel with a working surface C and substantially axially in relation to the fixing part 4 of the wearing part 1, whilst a normal force component $F_s$ acts substantially from above, perpendicular to the working surface C. The lateral transverse force component $F_p$ acts from the side or sides, substantially parallel with the working surface C and more perpendicular in relation to the extent of the said wearing tooth 1, i.e. the said tooth neck 5 thereof, which constitutes a more strongly protruding extension of the tooth body 2, in front of the tooth holder 10 of the wearing tooth 1, see FIG. 4. During use of the wearing part 1, the tooth neck 5 projects from and at a certain angle, firstly, to the rest of the tooth body 2, i.e. the angle $\alpha$ between the longitudinal axes X, Y through the fixing part 4 of the wearing tooth 1 and the tooth neck 5 respectively, which angle $\alpha$, in the embodiment shown in FIG. 1, comprises an optimal angle of 68° and, secondly, to the working surface C, which angle $\beta$ in the figure comprises an optimal angle of 112° to the shearing force component $F_c$, which acts along the said working surface C and at the angle $\delta$, which optimally comprises the angle 22°, to the normal force component $F_s$. In the shown embodiment, the longitudinal axis Y' of the hard metal rod 3 should therefore likewise be arranged at an optimal angle of 22° to the said normal force component $F_s$ and parallel with the front side 9 of the tooth neck 5 and the longitudinal axis Y of the tooth neck 5. This angle $\lambda$ can vary, however, preferably by ±0-15°, from the longitudinal axis Y' of the hard metal rod 3, which longitudinal axis is shown in FIG. 1 and arranged substantially concentrically in the tooth neck 5 and is also substantially parallel with the front side 9 of the tooth neck 5. The said angle $\alpha$ between the said longitudinal axes X, Y shown in FIG. 1 may preferably vary within an interval of 50°-90°. Note that arranged reinforcing portions, i.e. at least the spine portion 13 and the side wings 12, 12' of the wearing tooth 1, give rise to a cross-sectional area which increases down along the tooth neck 5 and which produces a blunter and blunter tooth neck 5 the more the wearing tooth 1 is worn down.

FIG. 4*a-d* show schematically parts of the hard metal rod 3 according to FIG. 1, FIG. 4*a-c* showing, in the form of two side views and a longitudinal section, the free end of the hard metal rod 3 protruding from the front tooth tip 6 of the tooth neck 5, i.e. its fixing shaft 16, on the right in the picture, and its cast-in end 17, which is metallurgically connected inside the tooth neck 5 in the cast steel 2, on the left. A desired breaking point 18 via a notch 19 in the form of a diametral change 18, and a recess 19 in the wearing end, i.e. the rod wearing surface 8, formed later, after removal of the fixing shaft 16, are also shown in FIG. 4*d*.

FIG. 5 shows a cross section through the tooth neck 5, in which a supporting zone 20 between the spine-shaped reinforcing portion 13 and the hard metal rod 3 and against the hard metal rod 3 is specifically shown, including the 0-90° change of position of the load acting in the plane of symmetry A, i.e. the variation in size of the shearing force component $F_c$ and of the normal force component $F_s$, during operation of the cutter head 11. The two force components $F_c$, $F_p$ produce, inter alia, negative bending loads, whilst $F_s$, which acts substantially vertically, can produce a load which advantageously compresses the hard metal rod 3, but which compressive load can give rise, however, to buckling and bending loads upon the cast steel 2 of the wearing tooth 1, so that the tooth neck 5 comprises back 13 and side wing 12, 12' reinforcements which counteract these drawbacks. In FIG. 5, an advantageous characteristic is shown, namely a cast steel 2 on the back of the tooth neck 5 against the fixing part 4 of the wearing part 1 is not abraded as much, since the predominant load, i.e. the shearing force component $F_c$, and hence its wear-down effect, acts on the front side 9 of the tooth neck 5, together with $F_p$ on its side edges 21, the hard metal rod 3, at its outer end, being supported against the hard metal rod 3 by a cast steel edge or supporting zone 20 on the back of the working tip wearing surface 7 of the tooth neck 5. The optimal wearing tooth 1 for dredger cutters must be designed for maximum resistance against the large loads and, at the same time, with a minimum cross-sectional area for maximum penetration. It will be appreciated that these requirements are mutually conflicting, so that, in previously known wearing teeth, without a reinforcing hard metal rod of, in relative terms, smaller diameter for increased penetrability inside the larger diametered cast steel, the length of the tooth neck had to be kept short to prevent the tooth neck 5 from being broken off. A long tooth neck 5 is bent back and forth by the variable loads, so that the long tooth neck 5 can suffer fatigue. This is prevented by a set balance between the E-modulus of the cast steel 2 and of the hard metal 3 and by the ratio between the cross section of the cast steel 2 and of the hard metal 3 down along the tooth neck 5.

FIG. 6 shows a schematic front view, of the front part of the tooth neck 5 comprising the lateral two parts 7*a*, 7*b* of the tip wearing surface 7 on either side of the wearing surface 8 of the exposed hard metal rod 3, which lateral two parts 7*a*, 7*b* of the tip wearing surface 7 here enclose the wearing surface 8 of the hard metal rod. FIG. 8 shows a cutter head 11 having shovel-shaped blades, to which there are fastened a number of tooth holders 10 with firmly fixed, but detachably arranged wearing teeth 1. FIG. 9 is a light-optical microphotograph of a bonding zone, also referred to as a transition zone, between the steel of the hard metal rod 3 and the cast steel 2, following etching with Murakami and Nital.

With reference to FIG. 7, one half of a shell sand mould 23 is shown schematically, comprising two shell parts, of which is shown one shell part 23', made of formed and hardened sand, which shell parts have been prefabricated in a reusable metal mould profiled according to a future wearing part 1, in which metal mould the spread-out sand mixed with bonding agent is left to harden into each of the said two shell parts, which are sufficiently rigid for the actual casting and which, because of their like shape along a longitudinal plane of symmetry, are hardened in the same metal mould. These two shell parts 23' therefore together form a space, which lends the wearing part 1 which is cast in the space, preferably but not exclusively a wearing tooth 1 for a dredger, its regular longitudinal shape along a longitudinal plane of symmetry A. It will be understood, however, that irregular wearing parts require various shapes.

The cast wearing part 1, following removal of the sand, for example by vibration, comprises a casting body 2, hereinafter also referred to as a tooth body 2, made of a below-defined casting alloy, hereinafter also referred to as cast steel 2, and at least one axially longitudinal cast-in part 3 of sintered hard metal, in this description rod-shaped, i.e. oblong, therefore referred to below as a hard metal rod 3. The hard metal rod 3 is preferably fixed with its centre in the force-neutral zone of the finished tooth body 2, i.e., in which tensile and compressive stresses are substantially equally large, along the A plane of symmetry inside the cast tooth body 2, prior to and during the casting by fastening in the respective shell part 23', and following the casting of an interface or bonding zone, see FIGS. 9 and 10, between the surface of the hard metal rod 3 and the cast steel melt, so as to produce at least one inner elongated wearing body comprising the hard metal rod 3 with increased wear strength and very high abrasion resistance in the centre of a tooth neck 5, with front tooth tip 6, protruding from the tooth body 2 of the wearing tooth 1. This tooth tip 6 has a high toughness in the cast steel 2 enclosing the hard metal rod 3, so that the tooth neck 5 acquires a much higher breaking strength through reinforcement by the hard metal rod 3. The tooth tip 6 comprises for this purpose, see FIG. 1 and FIG. 2, at least one outer tip wearing surface 7, which comprises, firstly, a wearing surface 8 of hard metal, preferably arranged substantially concentrically in the tooth neck 5 and in the longitudinal A plane of symmetry of the wearing tooth 1 (shown as a line in FIG. 2 and FIG. 3) and, secondly, two parts 7*a*, 7*b* of the tip wearing surface 7, which enclose the hard metal rod 3, preferably entirely, and is made of cast steel 2 with lower wear strength and lower abrasion resistance than the wearing surface 8 of the hard metal rod 3. FIG. 1 also shows, in addition to the longitudinal A plane of symmetry, a B plane of symmetry, which runs perpendicular to the said A plane, along the tooth neck 5 itself and the hard metal rod 3, and is substantially regular in its cross section, see FIG. 5, in this case excluding a spine-shaped reinforcing portion 13 for the absorption of the shearing force component $F_c$ of an acting load F. The resultant wearing part 1 thereby acquires, overall, both a highly increased wear strength and a many times increased breaking strength, at the same time as having a maintained high toughness and a self-sharpening effect, which self-sharpening effect is explained in greater detail below, which also applies to the strength properties of the said material.

The fixing of the hard metal rod 3 prior to the casting in the shell sand mould 23, see FIG. 7, comprises at least one fixture, for example one or more securing lugs 25, see FIG. 4*d*, at one end of the hard metal rod 3, hereinafter referred to as its fixing shaft 16, which fixing shaft 16, following the casting and the demoulding, constitutes a free end 16, protruding from the tooth neck 5, of the hard metal rod 3, whilst its cast-in end 17 opposite to the fixing shaft is held securely fixed by the said fixture inside the space which is to be filled with a casting melt from, for example, an induction furnace. One advantage with this process is that the hard metal rod 3 is fully fixed in its fixed position inside the casting mould 23, here the shell sand mould 23, during the casting, so that the hard metal rod 3 does not change position when the casting melt is poured in. Previous solutions have comprised, for example, various supports inside the said space, which supports were then melted and combined with the casting melt in the casting operation. It will be appreciated that this known process gives rise to a significant risk of the cast-in part 3 moving from the desired position when the supports melt and, moreover, this melt of the supports forms an impurity in the casting melt, which impurity alters the desired properties of the wearing part 1, the interface and the bonding zone 24 between the cast-in part 3 and the rest of the cast steel 2. For example, a poor adhesion can be caused, bubbles can appear in the cast steel 2 or at the said interface and bonding surface 24 during the casting of the wearing part 1. A poor adhesion also produces a deficient supporting zone 20 for the hard metal rod 3 during exposure to acting forces, so that it breaks more easily.

Following the opening of the shell sand mould 23 and the release of the wearing tooth 1, the fixing shaft 16 of the hard metal rod 3, which fixing shaft protrudes from the front tooth tip 6 of the tooth neck 5, is removed. A desired breaking point 18 via a notch 19 has expediently already been provided for this purpose during the forming of the hard metal and prior to its sintering into the finished hard metal rod 3, which breaking point 18, when the hard metal rod 3 is fixed in the shell sand mould 23, is arranged in a fixed manner close to the limit surface against the cast melt of the shell sand mould 23. The removal is expediently effected by the knocking off of the fixing shaft 16, since the hard metal rod 3 is sufficiently fragile for a break to occur substantially directly within or level with the outer tip wearing surface 7 of the tooth tip 6, if a sufficiently deep notch 19 has been made.

In FIG. 12*a-c* a separate fixing shaft 16 is shown schematically, which separate fixing shaft 16 is pressed onto the hard metal rod 3. The fixing shaft 16 is suitably made of a conventional steel of softer kind than the hard metal used for the cast-in end 17. The separate fixing shaft 16 is fixed onto the hard metal rod 3 by pressing a pair of grippers 16*a* and 16*b* into a pair of cavities 27*a*, 27*b* in the hard metal rod 3 at the opposite end of the cast-in end 17. After casting of the hard metal rod 3 in the cast steel 2, the removal of the fixing shaft 16 is easily done by removing the grippers 16*a* and 16*b* out of the cavities 27*a*, 27*b*.

Other conceivable ways of achieving a separation of the fixing shaft 16 of the hard metal rod 3 are, firstly, for a cheaper material, preferably a more conventional steel, to be welded or sintered as a fixing shaft 16 to the rest of the hard metal in the above-mentioned position for the desired break, whereafter the separation in this case can be easily effected simply with an inexpensive cut-off wheel which cuts through conventional steel but in which diamond cutters are required for the hard metal, and secondly for such a material shaft 16 to be fixed by mutually interacting pin and pin opening 26, 27, see FIG. 4*c*, one pin 26/opening 27 being provided in the preliminary stage of the hard metal rod 3, prior to the sintering of the same, and the opposite opening 27/the pin 26 in the fixing shaft 16 fitted after the sintering. The furnace type which is used in the melting of the cast steel 2 gives to some extent different temperatures of the casting melt, of which account has been taken in the temperature ranges below.

The casting of the hard metal rod 3 in the cast steel 2 is expediently effected at, expediently, about 1500-1700° C., primarily depending on the melting method, preferably 1550-1650° C. in respect of the pin temperature, the surface on the hard metal rod 3 forming the metallurgical said interface or the bonding zone 24 with the cast steel 2 enclosing the hard metal rod 3. In this fusion of the surfaces of the tooth body 2 and hard metal rod 3, any impurities or moisture can cause disadvantageous material impairments, cracks, gas bubbles and cavities, a poorer adhesion and an inferior strength in the interface, the bonding zone 24 or inside the cast wearing part 1.

The hard metal rod 3 can also be clad with one or more metal films, not shown, for example nickel or steel film in the interface or the bonding zone 24 between the hard metal rod 3 and the cast steel 2. If everything is properly managed, i.e. the cast-in part 3 is cleaned carefully and is kept dry, an advantageous shrink pretensioning is obtained through a volume contraction in the cast steel. The hard metal rod 3 is thus bound to the cast steel 2 along a casting joint cooperating between the separate steel materials, a shrink fit, comprising a compressive pretensioning, being formed, at the same time as a metallurgical bond is obtained in the said interface and bonding zone 24.

The removed hard metal rod fragment 16 can expediently be recovered for the production of new hard metal rods 3, which yields both positive environmental effects and economic advantages. Shell sand mould casting produces sufficiently smooth surfaces for most wearing parts, so that it is possible to produce wearing parts, for example, wearing teeth, with complex forms without major finishing works.

In a preferred embodiment, the hard metal rod 3 has a diameter of between 10 and 30 mm, preferably about 18-23 mm, in which the hard metal rod 3 can be somewhat conical, preferably with the larger diameter towards the inner cast-in end 17. The embodiments shown in the present application comprise, primarily, a hard metal rod 3, which is arranged concentrically in the force-neutral zone of the tooth neck 5, in the longitudinal A plane of symmetry, and substantially also in the B plane of symmetry perpendicular thereto, see FIG. 1, but it lies within the inventive concept to provide more hard metal rods should this be considered expedient. For example, an extra hard metal rod can be arranged peripherally in relation to the concentric hard metal rod 3 in a certain region of the cross section of the tooth neck 5 in which an extra wear protection reinforcement is desired. The rod wearing surface 8 of the hard metal rod 3 can comprise, for example, in terms of its cross section, a square, rectangular, circular, elliptical, in relation to one or both planes of symmetry A, B, lateral or tubular wearing surface. The above-stated with regard to the diameter is in this case regarded as the maximum width for non-circular cross sections. In the case of the tubular wearing surface, it is conceivable for the tube to be filled by a grade of steel which is different from the surrounding one. It will be appreciated that an inner cast-in part 3 can also, in turn, be enclosed by one or more steel grades. The hard metal rod can be configured, for example, as a truncated cone.

The hard metal rod 3 has an axial extent Z inside the tooth neck 5, which hard metal rod 3 runs substantially parallel or at a certain defined angle $\lambda$ to the longitudinal Y-axis of the tooth neck 5 running substantially parallel with the front side 9 of the tooth neck 5, see FIG. 1 and FIG. 5, which angle $\lambda$ lies within the range 0-15 degrees and in which the extent Z is about 80-95% of the length L of the tooth neck 5, measured from the free outer end of the original tooth neck 5, i.e. its original tip wearing surface 7, along the said longitudinal Y-axis, and which extent is clearly demarcated in the inward direction at the lower cast-in end 17 of the hard metal rod 3 and is there expediently rounded in order to reinforce the auto-signalling function of the wearing part 1.

The total wear length L of the projecting front neck 5 is the length measured from the centre of the original tip wearing surface 7 down to the upper side of the two reinforcing side wings 12, 12'. In other embodiments of the invention, not shown, the said axial extent Z of the elongated hard metal rod 3 may be about 65-95% of the total wear length L of the frontal projecting neck 5.

Since the hard metal rod 3 has a well-defined extent, i.e. the length Z of the hard metal rod 3, which is shorter than the total wear length L of the tooth neck 5, the effect is in fact achieved that the wearing tooth 1 is auto-signalling, i.e. that the wearing part 1 automatically advises that it is worn out and must be changed, this by virtue of the fact that registerable properties, for example changes in vibration or torque resistance in winches or the drive shaft, occur in the working tool 11 in which the wearing tooth 1 is fixed. The hard metal rod 3 is thus fixed in the tooth neck 5 at a certain distance from the top side of the tooth holder 10 of the wearing tooth 1, so that the tooth holder 10 is never at risk of coming into direct contact with the working surface C as a result of the tooth neck 5 having worn down too far, i.e. the wearing part 1 is changed upon the receipt of the auto signal, when the total working length L of the wearing part 1 has been consumed. Once the hard metal rod 3 is worn away, the working capability of the wearing tooth 1 and its sharpening is changed so much that, for example, vibrations arise, which vibrations are detected manually or by suitable sensor, and thereby alert the machine operator of the dredger, for example, that the existing, operating wearing teeth 1 are now in need of exchange.

This produces a much more advantageous and effective changing of the wearing part 1 than previously, since the cutter head 11 of the dredger had to be raised from the water in order to be able to check which wearing teeth 1 needed to be changed. This also meant that certain wearing teeth 1 were changed unnecessarily, since the cutter head 11 was up anyway and it was felt that the wearing tooth 1 would not last out to the next such visual inspection, and also as that certain wearing teeth 1 were changed too late and the tooth holders 10 thus suffered serious damage.

With the present invention, the advantageous further characteristics, inter alia, are obtained that all wearing teeth 1 can be changed very precisely, so that both an increased effectiveness of the working of the tool 11 is obtained and the number of unavoidable operating stoppages is considerably reduced. Nor is there a risk of the tooth holders 10 of the wearing tooth 1 becoming damaged if the change is made once the auto signal has been registered. Further advantages are, for example, that the hard metal rod 3 is actually worn right the way down before it is changed, so that the wearing tooth 1 which is left very often contains only one material, the cast steel 2. The recovery of the residual tooth thus becomes extremely simple. Should a change be made before the hard metal is totally off, this fragment can be cut off from the rest of the wearing part 1, whereafter the recovery of the residual tooth, which is in this case made of a homogeneous steel material, and of the remaining tooth neck fragment, with the valuable hard metal, is carried out separately. The hard metal can be easily separated, since it has a different melting point from that of the cast steel, about 1500-1700° C.

A further advantage is that the interface and the bonding zone 24 between the hard metal rod 3 and the rest of the cast steel 2 experiences a pretensioning in which the interface 24 acquires a characteristic allowing stronger detention of the hard metal rod 3. The bonding zone 24 between the hard metal rod 3 and the cast steel 3 comprises some molten hard metal, which has been dissolved and mixed together with the cast steel 2, whereby a harder hard metal core has been formed, surrounded by the softer cast steel and with a softer bonding zone, with a hardness of between 1220 to 1450 HV3, formed between the cast steel 2 and the hard metal core 3. The hard metal core 3 is thus fully intact and unaffected in spite of the casting into the cast steel 2. If a somewhat softer hard metal core were to be used than in the below-specified illustrative embodiment, the risk of cracking in the said bonding zone 24 is reduced, but the durability is then reduced when the tool 11 is used. In a preferred embodiment, the hard metal rod 3 has a mean hardness of about 800-1750 HV3.

After the fixing shaft 16 on the hard metal rod 3 has been removed according to the above, a small indentation can be found in the free front tip wearing surface 7 of the tooth neck 5, but since the self-sharpening resulting from the wear-down of this front tip wearing surface 7, i.e. the whetting of the tooth neck 5 of the wearing tooth 1, occurs rapidly, the hard metal rod 3 will be exposed and commence the loosening of the working surface C. Unlike a conventional wearing tooth without this inner rod wearing surface 8 within the tip wearing surface 7, which conventional wearing tooth always has a blunt contact surface against the working surface C, a penetrative effect in the wearing tooth 1 according to the invention is always obtained. The fact that, in the case of a one-sided or two-sided wear-down, which is the case where the wearing tooth 1 is fixed in place in its position on the tool 11, see especially FIG. 5 and FIG. 8, in which the tip wearing surface 7 of the wearing tooth 1, which are fixed in relation to the tooth holder 10, rub against the working surface C, a cutting edge 29 is formed, see FIG. 6, over the tip wearing surface 7, is of minor importance, since the rod wearing surface 8 of the hard metal 3, in relation to the tip wearing surfaces 7*a*, 7*b* of the cast steel, still constitutes a front-protruding tip. In the case of a rotary tip surface, no cutting edge is formed.

The self-sharpening effect is obtained by virtue of the fact that the cast steel 2 and the hard metal rod 3 have different abrasion resistance (also referred to as wear strength), in which the hard metal has the higher wear strength, so that the cast steel 2 having the lower resistance wears more quickly than the hard metal rod 3 enclosed by the cast steel 2 when the tool 11, and hence the wearing tooth 1, is used, so that a balance between the abrasion resistance of the cast steel 2 and of the hard metal 3 is obtained, and so the wearing tooth neck 5 is constantly sharpened as the hard metal rod 3 is exposed during use of the wearing tooth 1 and will therefore effectively penetrate the working surface C. Throughout, the hard metal rod 3 is that part of the wearing tooth 1 which sticks out farthest from the tooth neck 5 and is thus always working against the working surface C, whilst the cast steel 2 works to a lesser degree or not at all against the working surface C, until the hard metal rod 3 is completely worn away and the auto-reporting function automatically signals that a change of wearing part 1 is required.

In order to obtain a more defined self-sharpening effect in a wearing part 1, it can be advantageous to arrange the surrounding casting 2 concentrically around the hard metal rod 3 in the form of a plurality of layers, not shown, in which the abrasion resistance of each layer is different. The abrasion resistance of the layers is determined by their hardness and thickness. The structure of the layers can be varied in a large number of ways. In order to produce a gradually increasing abrasion resistance radially inwards towards the hard metal rod 3, the thickness and hardness of the layers can be increased in steps inwards within the cross section of the tooth neck 5. Alternatively, the layers can be arranged such that the abrasion resistance is increased along the length of the hard metal rod 3. By varying the number, thickness and hardness of the layers in a predetermined manner, it is thus possible to also custom-design wearing parts 1 for different applications. Depending on the character of the wear, it can be advantageous to have different self-sharpening profiles. In a certain application, a conical self-sharpening profile may be advantageous, in another application a convex self-sharpening profile, etc.

In certain applications, the wear is unevenly distributed around the wearing part 1, which means that certain parts of the wearing part 1 get more worn than others. It may then be advantageous to distribute the layers in a correspondingly uneven manner around the wearing part 1 to compensate for the uneven wear.

Where wearing teeth 1 are used in a dredger in which the cutter head 11 rotates in pendulum motions, a wear-down occurs on either side of the longitudinal plane of symmetry A of the wearing tooth 1, so that the ridge-shaped cutting edge 29 is formed substantially directly over the middle of the hard metal. This cutting edge 29 is then constantly whetted by the said rotary and pendulum motions, until the hard metal rod 3 runs out.

A further advantage compared with the tip surface of the conventional wearing tooth is that the hardest portions of the worked surface are broken up by the hard metal tip 8, whilst the more conventional parts 7*a*, 7*b* of the tip wearing surface 7 of cast steel 2 around this hard metal tip 8 then acquires a lower wear-down rate and thus an increased effect per wear-down length, since the working surface C is therefore already loosened. The service life of the wearing tooth 1 can thus be improved by several hundred %.

The working length Z on the hard metal rod 3 is arranged such that, when the tooth tip 6 is at risk of becoming too blunt, the hard metal rod 3 distinctly runs out, since the total cross section of the tooth neck 5, comprising the tooth neck 5 itself, which can also, in its own right, be increasing substantially concentrically downwards around the hard metal rod 3, at least on its lateral 21 and rear sides 14, and the surrounding reinforcing portions 12, 13, comprising the back portion 13 and side wings 12, 12' shown in FIG. 1-3, preferably increases downwards towards the tooth holder 10, so that the durability-enhancing effect of the hard metal rod 3 abruptly vanishes and gives, more or less immediately, a blunt wearing tooth 1, which produces such a large increase in vibrations and/or such a recordably lower working capability against the working surface C, and hence also such a noticeable or detectable loss of production, that the operator is alerted to the need for the wearing tooth 1 to be changed.

Due to the fact that the cast steel 2 around the hard metal rod 3 is worn down faster, it will always be the hard metal rod 3 that carries out the substantial part of the cutting, wearing or penetrative action of the wearing part 1, which effect we call self-sharpening. This leads to the advantage that the wearing tooth 1 is more easily able to penetrate hard types of soil and rock, etc., whereby the wearing tooth 1 acquires a greater efficiency. Previously used conventional wearing teeth go blunt very quickly, since they have no hard metal tip, and thus conventional wearing teeth lose their function much more quickly.

A further advantage is achieved by the capability to increase the strength of the front end of the wearing tooth 1 along the tooth neck 5, since is possible to use more cast steel 2 around this end without obtaining the otherwise negative effect of bluntness with no penetrability. This means, for example, that even hard rock is able to be penetrated and crushed with the wearing parts 1 on the cutter head 11 of the dredger. In addition, it is advantageous to arrange reinforcing portions, such as the said reinforcing side wings 12, 12' and the spine-shaped reinforcing portion 13, on that back of the tooth neck 5 of the wearing tooth 1 which is facing away from the nose of the cutter head 11, or on the sides 21 lateral to the back 14, which spine-shaped reinforcing portion 13 and reinforcing side wings 12, 12' stiffen the tooth neck 5 such that it can be made considerably longer without being broken off, so that the working length of the tooth neck 5, i.e. the length which can be worn down before the wearing tooth 1 has to be changed, becomes a great deal longer than in a corresponding concentric tooth neck with no such reinforcement. The cutter head is previously known, for example, in which each wearing tooth 1 comprises a rotary cylindrical tip, which has to have a very short neck so as not to be broken off, so that these wearing teeth with cylindrical tip need changing very frequently, resulting in a large number of costly operating stoppages.

A preferred embodiment of the wearing tooth 1 according to the invention comprises a cross section which increases towards the base of the tooth neck 5, which cross section can comprise, respectively, a tooth neck enclosing the hard metal rod 3 on preferably all sides 14, 21, 9 and having one or more or all sides 14, 21, 9 of cross section which increases towards the base of the tooth neck 5, a reinforcing spine 13 of cross section which increases towards the base of the tooth neck 5, two opposite sections, i.e. one on either side of the hard metal rod 3, arranged cast steel sections of cross section which increases towards the base of the tooth neck, such as side wings 12, 12', or a combination of two or more of the said alternatives.

With the above-specified configurations having the hard metal rod 3 enclosed in the tooth neck 5, the properties of the new wearing tooth 1 turn out to be at least as advantageous as today's conventional wearing teeth with respect to the cast steel body, at the same time as the placement of the hard metal rod 3 in at least the centre of the tooth neck 5 means that the properties of the wearing tooth 1, for example the breaking strength, etc. increase. If the tooth tip 6 and the tooth neck 5 become worn from two opposite directions, in which each steel material has a specific mutual balance such that the wearing of the respective steel materials is precisely matched to one another, a sharp edge 29 is formed as a centre line transversely across the tip wearing surface 7 between two opposite, angled parts 7*a*, 7*b* of the tip wearing surface 7, which sharp edge 29 acts like a sharp knife and cuts loose new material, if more angled wearing surfaces are formed, an awl-like tip is instead obtained, which further scrapes loose new material.

The knife function is reinforced, moreover, by the cross section shown in FIG. 1, comprising the spine-shaped reinforcing section 13, which makes it possible to produce longer tooth necks 5 which can therefore wear much longer than a, for example, round tooth neck, which is broken once the bending strength, for example, cannot cope with the lengths achievable with the reinforced embodiment shown in FIG. 1. The relationship between the length and diameter of the round tooth neck should not be greater than 2 before the working characteristics are impaired, or the risk of breakage becomes too great. With the configuration having the reinforcing portions, i.e. the back portion 13 and the side wings 12, 12' transversely to the tip wearing surface 7, the tooth neck length can be about 3-5 times greater than the transverse measurement of the tooth neck 5 at the front end of the tooth neck 5, as is shown in FIG. 1, which then multiplies the working length, and hence the period of use of the wearing tooth 1, without the working characteristics becoming impaired or the risk of breakage becoming too great.

A further advantage with a spine-shaped profile 13 and with a cutting tip surface form 29, as in FIG. 1-3, is that the actual wearing tooth 1 also operates with a shovel function, which transports and carries away the loosened working materials.

ILLUSTRATIVE EMBODIMENTS

In the specifically shown embodiment of

The following preferred casting alloy, also referred to above as cast steel, comprises a mainly iron-based (Fe) 95.0-96.0% by weight alloy, in which the alloy materials preferably comprise

Illustrative Embodiment 1

Percent by Weight

The Chemical Composition of the Cast Steel:
C 0.24-0.28% by weight
Si 1.40-1.70% by weight
Mn 1.00-1.40% by weight
P max 0.025% by weight, preferably 0.020% by weight
S max 0.020% by weight, preferably 0.013% by weight Cr 1.25-1.50% by weight
Ni 0.40-0.60% by weight
Mo 0.17-0.22% by weight
Al max 0.03-0.08% by weight, preferably 0.045% by weight
Ti max 0.04-0.10% by weight, preferably 0.07% by weight
N max 180 ppm, preferably 120 ppm,
DI hardenability index min 6.6, preferably 7.3, max 10.8.
Heat Treatment:

Full annealing/normalization at 900-1050° C. Time: min 3 hours±1 hour, or 1 hour/25 mm length.

Cooling in the open air, heating to 850-1000° C. Time: 1 hour±0.5 hour. Hardening in water-polymer bath or water.

Tempering at 200-300° C. Time: 3 hours±1 hour, or 1 hour per 25 mm length, cooling in the open air. All times are based on the whole of the component part being up in temperature.
Mechanical Properties:

| | | |
|---|---|---|
| Brinell-hardness | HB | min 450, preferably 475 |
| Yield point | $R_{p0.2}$ | min 1200 MPa, preferably 1300 MPa |
| Breaking strength | $R_m$ | min 1450 MPa, preferably 1550 MPa |
| Elongation | $A_5$ | min 2%, preferably 5% |
| Area reduction | Z | min 4%, preferably 10% |
| Impact strength | KV + 20 | min 12 J, preferably 15 J |
| Impact strength | KV − 20 | min 12 J, preferably 12 J |
| E-modulus for the cast steel | | 195-220 GPa |

Hardness is measured after casting and 2 mm grind.

The Chemical Composition of the Hard Metal:
10-25% by weight Co and/or Ni with tungsten carbide of approx. 0.5-7.0 μm grain size.
Vickers hardness 3 800-1750 HV3
Properties of the Interface or Bonding Zone:
Vickers hardness 3 1220-1450 HV3

Illustrative Embodiment 2

Percent by Weight

The Chemical Composition of the Cast Steel:
C 0.31-0.36% by weight
Si 1.10-1.50% by weight
Mn 0.80-1.10% by weight
P max 0.025% by weight, preferably 0.015% by weight
S max 0.015% by weight, preferably 0.010% by weight
Cr 1.00-1.40% by weight
Ni max 0.50% by weight
Mo 0.20-0.30% by weight
Al max 0.03-0.08% by weight, preferably 0.045% by weight
Ti max 0.04-0.10% by weight, preferably 0.07% by weight
N max 180 ppm, preferably 120 ppm,
DI hardenability index min 6.6, preferably 7.3, max 10.8.
Heat Treatment:

Full annealing/normalization at 900-1050° C. Time: min 3 hours±1 hour, or 1 hour/25 mm length.

Cooling in the open air, heating to 850-1000° C. Time: 1 hour±0.5 hour. Hardening in water-polymer bath or water.

Tempering at 200-300° C. Time: 3 hours±1 hour, or 1 hour per 25 mm length, cooling in the open air. All times are based on the whole of the component part being up in temperature.
Mechanical Properties:

| | | |
|---|---|---|
| Brinell-hardness | HB | Min 500, preferably 530 |
| Yield point | $R_{p0.2}$ | min 1300 MPa, preferably 1400 MPa |

-continued

| | | |
|---|---|---|
| Breaking strength | $R_m$ | min 1600 MPa, preferably 1700 MPa |
| Elongation | $A_5$ | Min 2%, preferably 4% |
| Area reduction | Z | Min 4%, preferably 8% |
| Impact strength | KV + 20 | Min 10 J, preferably 14 J |
| Impact strength | KV − 20 | Min 8 J, preferably 10 J |

Hardness values are measured after casting and 2 mm grind at specified location.
Test bar 50 × 35 mm Metallurgical Aspects and Further Configurations The cast steel 2 has a composition having a carbon equivalent $C_{eq}$=% by weight C+0.3 (% by weight Si+% by weight P), which is less than 0.9% by weight, preferably less than 0.8% by weight, but still exceeding 0.1% by weight, preferably exceeding 0.5% by weight. The cast steel will preferably be composed of Cr, Ni, Mo low-alloyed steel material having a melting point of about 1450-1550° C. The hardness of the cast steel lies between 45 and 55 HRC.

The invention can be applied to tungsten carbide (WC)-based hard metals with a bonding phase of Co and/or Ni, preferably having a carbon content which lies close to the formation of free graphite and which, in the case of hard metal with a bonding phase of cobalt, means that the magnetic cobalt content is 0.9-1.0 of the nominal cobalt content. Up to 5% by weight carbides of Ti, Cr, Nb, Ta or V can be present.

In a preferred embodiment intended for earth-shifting tools, for example dredger cutters, the hard metal has a bonding phase content of 10 to 25% by weight Co and/or Ni with tungsten carbide (WC) of between 0.5 and 7 μm grain size.

The transition zone between the hard metal and the cast steel has a good bonding, which is essentially free from cavities and cracks. Some few cracks in the zone between the cast steel and the hard metal will not, however, seriously affect the performance of the product. In the transition zone/bonding zone there is a thin eta-phase zone having a thickness of between 50 and 200 μm (B). In the hard metal closest to the eta-phase zone, there is an iron-containing bonding zone with a width of 0.5 to 2 mm (C). In the steel closest to the eta-phase zone, there is a zone with increased carbon content (E) of between 10 and 100 μm thickness. According to the casting method, the hard metal rod is fixed in a mould and molten steel is poured into the mould. The temperature of the molten steel when poured into the mould is between 1550 and 1650° C. Preferably, the hard metal rod is preheated by the cast steel melt passing into the mould around the hard metal rod fixed there in correct position. The cooling takes place in the air. Following the casting, standard heat treatment is carried out to harden and temper the steel.

EXAMPLE 1

Cylindrical hard-metal rods of 22 mm diameter and 120 mm length, with 5% by weight Ni and 10% by weight Co, and the rest tungsten carbide (WC) of 4 μm grain size, were produced by conventional powder metallurgical methods. The carbon content was 5.2% by weight and the hardness 1140 HV3.

The rods were fixed in moulds for producing wearing teeth for the VOSTA T4 system, which is used in the cutter head for a dredger. A CNM85-type steel, with 0.26% by weight C, 1.5% by weight Si, 1.2% by weight Mn, 1.4% by weight Cr, 0.5% by weight Ni and 0.2% by weight Mo, $C_{eq}$=0.78, was melted down, and the molten mass with temperature of 1570° C. was poured into the moulds. The hard metal rod was preheated by the cast steel melt passing into the mould around the hard metal rod fixed there in correct position. Following air cooling, the teeth were normalized at 950° C. and hardened at 920° C. Tempering at 250° C. was the final stage in the heat treatment before the product acquired its final form by grinding.

A tooth was selected for a metallurgical examination of the transition zone between hard metal/cast steel in the tooth. A cross section of the tooth was prepared by cutting, grinding and polishing. The transition zone between hard metal/steel was examined in a light-optical microscope, LOM. The LOM study was conducted both on an unetched surface and on a Murakami and Nital etched surface, see FIG. 9 and FIG. 10. The bonding between the steel and the hard metal was good and essentially without cavities and cracks. Between the hard metal and the steel there was found a 100 μm thick eta-phase zone, B. Present in the hard metal was an iron-containing transition zone, C, having a thickness of 1.5 mm on top of the unaffected hard metal, D. In the steel there is a carbon-reinforced zone of 50 μm, E. The distribution of tungsten W, cobalt C, iron Fe and chromium Cr over the bonding zone was also examined by electron-probe microanalysis. FIG. 11 shows the distribution of tungsten W, cobalt C, iron Fe and chromium Cr along a line perpendicular to the bonding zone, and it was found that the transition zone, C, is essentially composed of tungsten carbide in an iron bonding phase.

EXAMPLE 2

Example 1 was repeated with a hard metal grade which had a composition of 20% by weight Co, the rest tungsten carbide (WC) of 2 μm grain size. The magnetic Co content was 18.4% by weight and the hardness 900 HV3.

Alternative Embodiments

The invention is not limited to the shown embodiment, but can be varied in various ways within the scope of the patent claims.

Self-Sharpening, Auto-Signalling Wearing Part

1. wearing part, wearing tooth
2. 1st material part, casting body, casting, cast steel
3. 2nd material part, cast-in part, elongated hard metal rod
4. fixing part, tooth shaft
5. tooth neck, projecting neck
6. tooth tip, outer tip
7. tip surface, tooth tip wearing surface
8. free wearing surface, rod wearing surface
9. front side of the tooth neck
10. holder part, tooth holder
11. working tool
12. side wing 12, 12'
13. spine-shaped reinforcing portion 13, the spine portion
14. the back 14 of the front part of the tooth neck 5
15. torque lug
16. fixing shaft, hard metal rod
17. cast-in end, hard metal rod in cast steel
18. breaking point, diametral change
19. notch, recess
20. cast steel edge or supporting zone
21. side edges
22.
23. shell sand mould, shell part 23'
24. interface or bonding zone
25. fixture, securing lugs 25
26. pin and
27. pin opening
28.
29. cutting edge
30. longitudinal axes X, Y
angle α
angle β
angle δ
angle λ
shearing force component $F_c$
normal force component $F_s$
lateral transverse force component $F_p$
working surface C
length (Z) of the hard metal rod (3)
length (L) of the tooth neck
42. plane of symmetry A
43. plane of symmetry B

The invention claimed is:

1. A wearing part having improved abrasion resistance and strength, which wearing part comprises at least a first and a second material part, which first material part is constituted by a casting body of a casting alloy, which casting body comprises:

a rear fixing part for detachable fixing to a holder part in a working tool and in which working tool the wearing part constitutes an exchangeable consumable part, and also a front neck, projecting from and at an angle to the longitudinal axis through the rear fixing part, which projecting front neck has an outer tip, having at least one tip wearing surface placed outermost on the said outer tip and which tip wearing surface constitutes the part which is to work actively against a working surface, the said projecting neck being worn down starting from the at least one tip wearing surface at the said outer tip, wherein the second material part is comprised of at least one elongated hard metal rod, which at least one elongated hard metal rod is fixed in the longitudinal plane of symmetry of the wearing part, substantially axially inside the projecting neck of the first material part, which at least one elongated hard metal rod comprises at least one free rod wearing surface constituting a part of the larger tip wearing surface of the said outer tip, whilst all other sides of the at least one elongated hard metal rod(s) are enclosed and fixed in place by the said first material part, wherein the at least one elongated hard metal rod of the wearing part is arranged with its centre in the force-neutral zone of the projecting neck, substantially concentrically in the longitudinal axis of the projecting neck, and comprises a length which is shorter than the length of the projecting neck with an inner cast-in end distinctly terminated at a certain distance from the longitudinal axis of the rear fixing part, so as to produce an auto signal comprising registerable vibrations at the final wearing-away of the inner cast-in end and by that an auto-reporting function that a change of wearing part is required during operation.

2. The wearing part according to claim 1, wherein the inner cast-in end, at the fixation of the rear fixing part inside the holder part, is terminated at a certain distance from the top side of the tooth holder and hence also at a certain further distance from the longitudinal axis of the rear fixing part inserted into the tooth holder.

3. The wearing part according to claim 1, wherein, the first material part comprises a material which has a lower abrasion resistance than the elongated hard metal rod, and in that that the ratio between the lower strength of the first material part and the higher strength of the elongated hard metal rod is made such that the free rod wearing surface of the elongated hard metal rod in relation to the rest of tip wearing surfaces of the first material part is always more protruding than the surrounding projecting neck so as to produce a self-sharpening capability.

4. The wearing part according to claim 1, wherein the wearing part comprises at least two wearing surfaces having different abrasion resistance, which said at least two wearing surfaces are arranged such that the abrasion resistance rises in the radial direction of the elongated hard metal rod so as to produce a self-sharpening capability of the wearing part.

5. The wearing part according to claim 4, wherein the at least two wearing surfaces of the wearing part are arranged in concentric layers around the elongated hard metal rod.

6. The wearing part according to claim 1, wherein the elongated hard metal rod is arranged at an angle (λ) within the range 0-15 degrees in relation to the longitudinal axis of the projecting neck.

7. The wearing part according to claim 1, wherein the elongated hard metal rod is arranged with a length which is between 80-95% of the length of the projecting neck calculated from the centre of it's original tip wearing surface of the outer tip.

8. The wearing part according to claim 1, wherein the elongated hard metal rod is constituted by a material which has a mean hardness of between 800 and 1750 HV3.

9. The wearing part according to claim 1, wherein the working tool for the wearing part comprises a sensor arranged to register the registerable vibrations at the final wearing-away of the inner cast-in end and by that indicate that the elongated hard metal rod is worn out and must be changed.

10. The wearing part according to claim 1, wherein the elongated hard metal rod is configured as a truncated cone.

11. The wearing part according to claim 1, wherein the elongated hard metal rod has a maximum width of between 10 mm and 30 mm.

12. The wearing part according to claim 1, wherein the cross section of the elongated hard metal rod transversely to the longitudinal axis of the elongated hard metal rod has a square or rectangular form.

13. The wearing part according to claim 1, wherein the cross section of the elongated hard metal rod transversely to the longitudinal axis Y' of the elongated hard metal rod has a circular or elliptical form.

14. The wearing part according to claim 1, wherein the wearing part comprises a first hard metal rod arranged centrally in the said wearing part and at least one further hard metal rod arranged peripherally in relation to the first hard metal rod.

15. The wearing part according to claim 1, wherein the wearing part comprises at least one reinforcing portion disposed between the outer tip of the wearing tooth and the rear fixing part of the wearing tooth.

16. The wearing part according to claim 2, wherein the first material part comprises a material which has a lower abrasion resistance than the elongated hard metal rod, and in that that the ratio between the lower strength of the first material part and the higher strength of the elongated hard metal rod is made such that the free rod wearing surface of the elongated hard metal rod in relation to the rest of tip wearing surfaces of the first material part is always more protruding than the surrounding projecting neck so as to produce a self-sharpening capability.

17. The wearing part according to claim 2, wherein the wearing part comprises at least two wearing surfaces having different abrasion resistance, which said at least two wearing surfaces are arranged such that the abrasion resistance rises in the radial direction of the elongated hard metal rod so as to produce a self-sharpening capability of the wearing part.

18. The wearing part according to claim 3, wherein the wearing part comprises at least two wearing surfaces having different abrasion resistance, which said at least two wearing surfaces are arranged such that the abrasion resistance rises in the radial direction of the elongated hard metal rod so as to produce a self-sharpening capability of the wearing part.

19. The wearing part according to claim 1, wherein the elongated hard metal rod is arranged with a length which is between 80-95% of the length of the projecting neck calculated from the centre of it's original tip wearing surface of the outer tip.

20. The wearing part according to claim 1, wherein the elongated hard metal rod is arranged with a length which is between 80-95% of the length of the projecting neck calculated from the centre of it's original tip wearing surface of the outer tip.

* * * * *